US005694707A

United States Patent [19]

Conte

[11] Patent Number: 5,694,707

[45] Date of Patent: Dec. 9, 1997

[54] SPORTS SHOE WITH IMPROVED SAFETY

[75] Inventor: Gino Conte, Caerano S. Marco, Italy

[73] Assignee: Roces S.R.L., Montebelluna, Italy

[21] Appl. No.: 701,540

[22] Filed: Aug. 22, 1996

Related U.S. Application Data

[63] Continuation of Ser. No. 438,610, May 10, 1995, abandoned.

[30] Foreign Application Priority Data

Jun. 9, 1994 [IT] Italy ..... MI9400418 U

[51] Int. Cl.[6] ..... A43B 5/04; A43B 5/16

[52] U.S. Cl. ..... 36/115; 36/50.5; 280/11.22

[58] Field of Search ..... 280/11.22, 11.23; 36/50.5, 115, 117.1

[56] References Cited

U.S. PATENT DOCUMENTS

| | | | |
|---|---|---|---|
| 2,531,763 | 11/1950 | Andre | 36/50.5 X |
| 3,362,091 | 1/1968 | Drago | 36/117 X |
| 3,363,288 | 1/1968 | Lange et al. | 36/50.1 X |
| 4,011,634 | 3/1977 | Olivieri | 36/50.5 X |
| 4,104,766 | 8/1978 | Salomon | 36/50.5 X |
| 4,150,500 | 4/1979 | Delery | 36/50.5 X |
| 5,171,033 | 12/1992 | Olson et al. | 280/11.22 |
| 5,193,827 | 3/1993 | Olson | 280/11.22 X |
| 5,237,759 | 8/1993 | Chaigne | 36/50.5 X |
| 5,342,070 | 8/1994 | Miller et al. | 280/11.22 |
| 5,411,278 | 5/1995 | Wittmann | 280/11.22 |
| 5,486,011 | 1/1996 | Nelson | 280/11.22 X |

FOREIGN PATENT DOCUMENTS

| | | | |
|---|---|---|---|
| 2000303 | 7/1971 | Germany | 36/121 |
| 0693341 | 8/1965 | Italy | 36/121 |

*Primary Examiner*—Ted Kavanaugh

*Attorney, Agent, or Firm*—McAulay Fisher Nissen Goldberg & Kiel, LLP

[57] ABSTRACT

Sports shoe with improved safety, including closure levers (13), arranged centrally with respect to either one of the upper metatarsal region (7) and the foot instep region (8) and the front tibial region. The levers are arranged transversely and centrally and any portion protruding from the gear is arranged only at the central region of the shoe.

9 Claims, 2 Drawing Sheets

SPORTS SHOE WITH IMPROVED SAFETY

This application is a continuation of application Ser. No. 08/438,610, filed May 10, 1995, now abandoned.

BACKGROUND OF THE INVENTION

1. Field of the Invention

The present invention relates to a sports shoe with improved safety, for roller skates, ice skates, ski boots and the like.

2. Description of the Prior Art

Conventional sports shoes are generally constituted by a quarter articulated to a shell. In roller skates, for example, a generally U-shaped frame is associated below the shell and in-line wheels are pivoted between the wings of the frame.

One of the problems that currently arises in the use of these boots or skates is that the quarter and the shell are secured by levers that protrude laterally with respect to the shoe.

These levers are in fact usually constituted by a lever arm which is articulated to a first base associated with one of the flaps to be joined and has a toothed region. A pivot is associated with a second base, that is rigidly coupled to the other flap, and engages the toothed region.

These conventional levers have a lever arm that necessarily protrudes with respect to the base and is arranged at the lateral region of the foot or of the tibia of the user.

The protruding lever is a potential danger for the user wearing a skate, a ski boot, or any other sports shoe, because the lever may accidentally collide, during sports practice, with the snow-covered surface or with any obstacle, such as, for example when skating, a curb or a pole. The user may in fact lose his/her balance and the lever may be easily damaged.

Furthermore, the lever may be damaged every time the user falls.

The aim of the present invention is to obviate the described technical problems by providing a sports shoe, such as ice skates, roller skates, or ski boots, wherein the closure levers are not affected by accidental impacts during sports practice An object is to provide a sports shoe wherein the levers are not affected by impacts if the user falls during sports practice.

Another object is to provide a sports shoe which can be used for any type of sports and at the same time ensures optimum securing of the flaps to be joined.

Another object is to provide a sports shoe having low manufacturing costs.

Another object is to provide a structurally simple sports shoe wherein the levers may be easily operated.

SUMMARY OF THE INVENTION

This aim, these objects, and others which will become apparent from the description that follows are achieved by a sports shoe as claimed in the appended claims.

BRIEF DESCRIPTION OF THE DRAWINGS

These and other objects will become apparent during the description that follows, which must be considered together with the accompanying drawings, which illustrate by way of non-limitative example a particular embodiment in which.

DESCRIPTION OF THE PREFERRED EMBODIMENTS OF THE INVENTION

Figure 1:
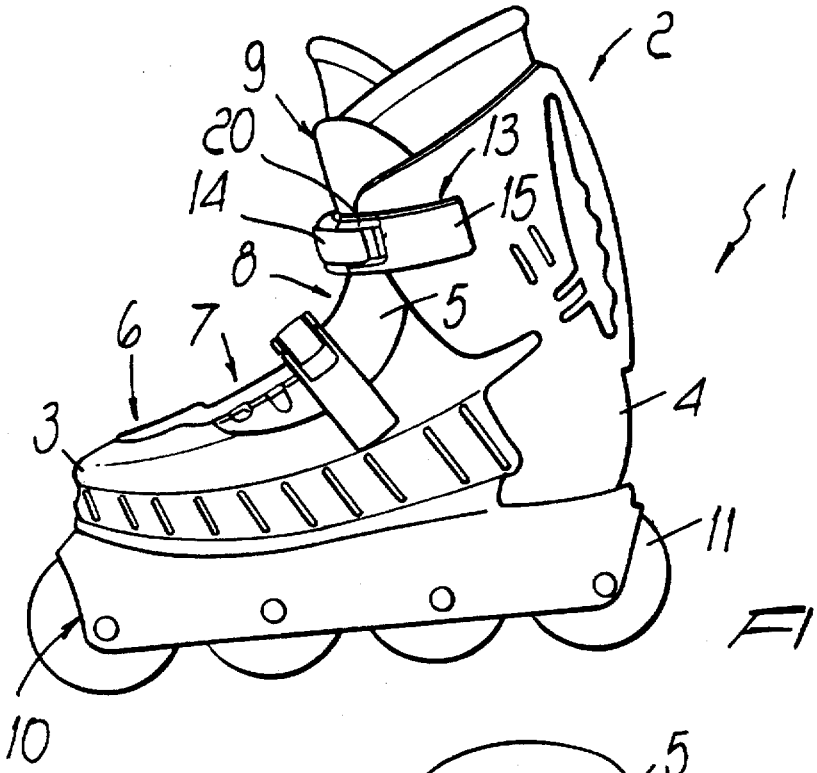
FIG. 1 is a side perspective view of an in-line skate according to the invention.
Figure 2:
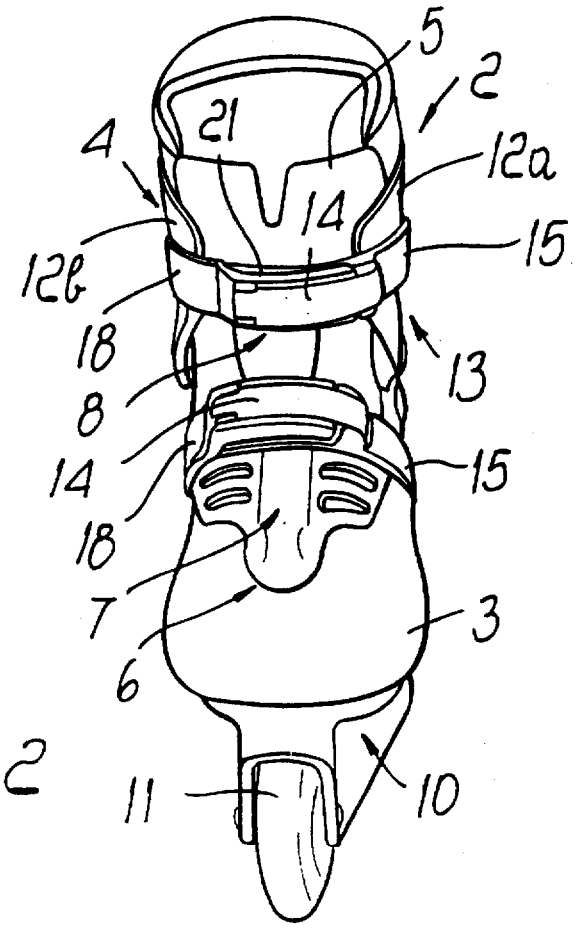
FIG. 2 is a front perspective view of the skate of FIG. 1.
Figure 3:
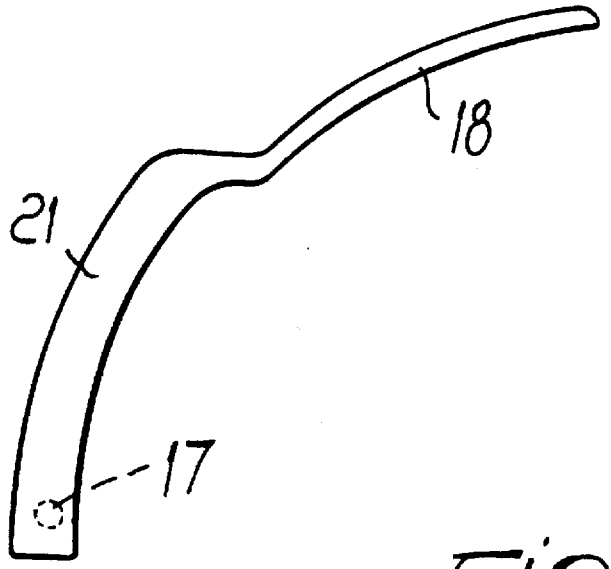
FIG. 3 is a side partial view of one of the components of the lever of the shoe according to the invention.
Figure 4:
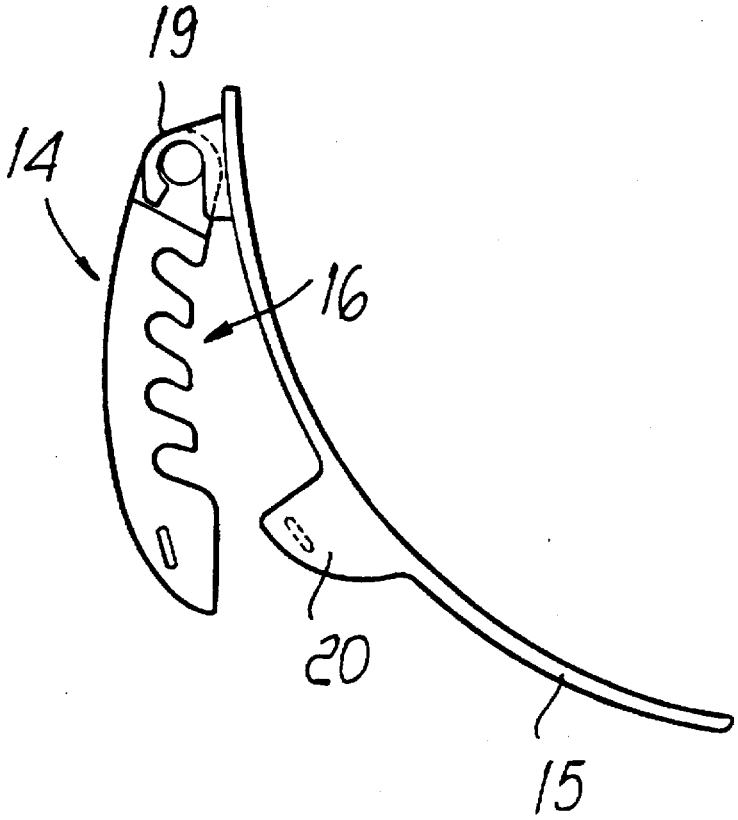
FIG. 4 is a side partial view, similar to the preceding one, of the other components of the lever.

With reference to the above figures, the numeral 1 designates a skate including a shoe 2 comprising a shell 3, a quarter 4 and a tongue 5. The tongue affects the toe region 6, the upper metatarsal region 7, the foot instep region 8, and the front tibial region 9.

A U-shaped frame 10 is associated below the shell 3 and a plurality of aligned wheels 11 are pivoted between the wings of the frame.

A set of levers 13 are adapted to secure the flaps **12*a*, 12*b* of the quarter 4, the tongue 5, and the shell 3. Each lever 13 comprises a lever arm 14 having a toothed region 16, that is articulated, at one end, to a first base 15. First base 15 is associated with one of the flaps to be joined, or with the shell. A pivot 17 selectively interacts with the toothed region 16 and is transversely associated with a second base 18. Second base 18 is associated with the other flap to be joined, or with the shell 3** again.

The characteristic of these levers 13 is that they are located transversely and centrally with respect to the upper metatarsal region 7 and/or to the foot instep region 8 and to the front tibial region 9, so that their protruding parts, such as the lever arm 14, the pairs of shoulders 19 to which the arm is transversely pivoted, any tabs 20 for connecting the lever arm to the first base 15, and any wings 21 for connecting the pivot 17 and the second base 18, are located exclusively at the central region of the shoe without thus affecting its lateral regions.

The sports shoe according to the invention therefore achieves the intended aim and objects. The particular position of the lever makes it safe from accidental impacts during sports practice.

The sports shoe according to the invention is susceptible to numerous modifications and variations, all of which are within the scope of the inventive concept. All the details may furthermore be replaced with other technically equivalent elements.

In practice, the materials employed, as well as the dimensions, may be any according to the requirements.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended as limiting. The invention is limited only as defined in the following claims and the equivalents thereto.

I claim:

1. A sports shoe assembly comprising:

a shoe having a front portion, a first side portion, and a second side portion at least partially opposite said first side portion, said first side portion having a forward edge arranged facing said front portion and said second side portion having a forward edge arranged facing said front portion, such that said forward edges of said first and second side portions are mutually spaced from one another;

a tongue portion arranged at said front portion and extending between the mutually spaced forward edges of said first and second side portions;

a first base having a front end and a rear end, said rear end of said first base being mounted on said first side portion, said front end of said first base being a free end extending forward of said forward edge of said first side portion;

a second base having a front end and a rear end, said rear end of said second base being mounted on said second side portion, said front end of said second base being a free end extending forward of said forward edge of said second side portion;

a lever arm pivotably mounted at one end thereof to said front end of said first base, said lever arm being selectively pivotable between an open position and a latched position, said lever arm having at least one tooth;

a pivot connection for pivotally mounting said lever arm to said front end of said first base, said pivot connection being arranged over said tone portion between the forward edges of said first and second side portions; and a pivot mounted on said front end of said second base, said pivot being engageable with said tooth, said pivot being arranged over said tongue portion between the forward edges of said first and second side portions.

2. A sports shoe assembly as defined in claim 1, wherein said lever arm extends from said pivot connection towards said forward edge of said first side portion and is substantially centered over said tongue portion of said shoe upon engagement of said pivot with said tooth, and upon a pivoting of said lever arm into said latched position.

3. A sports shoe assembly as defined in claim 1, wherein said shoe includes a shell having a front section and a rear section, and a quarter attached to said shell at said rear section thereof, said tongue portion being attached to said shell at said front section thereof, and said tongue portion extending at a toe region, an upper metatarsal region, a foot tibial region, and a front tibial region of the shoe.

4. A sports shoe assembly as defined in claim 3, wherein said first and second side portions are oppositely arranged side portions of said shell.

5. A sports shoe assembly as defined in claim 3, wherein said quarter has a first flap and a second flap substantially opposite said first flap, and said first side portion including said first flap, said second side portion including said second flap, and wherein said first base is connected to said first flap, and said second base is connected to said second flap.

6. A sports shoe assembly as defined in claim 1, wherein upon engagement of said pivot with said tooth and upon a pivoting of said lever into said latched position, said lever arm extends entirely between said pivot connection and said forward edge of said first side portion.

7. A sports shoe assembly as defined in claim 1, further comprising a pair of tabs protruding from said forward end of said first base for releasably holding said lever arm in said latched position, said tabs being arranged over said tongue portion and extending entirely between the forward edges of said first and second side portions.

8. A sports shoe assembly as defined in claim 1, further comprising a pair of wings protruding from said forward end of said second base and between which said pivot is connected, said pair of wings being arranged over said tongue portion and extending entirely between the forward edges of said first and second side portions.

9. A sports shoe assembly as defined in claim 1, wherein upon engagement of said pivot with said tooth and upon a pivoting of said lever into said latched position, said lever arm extends entirely between said pivot connection and said forward edge of said first side portion, and wherein the sports shoe further comprises:

a pair of tabs protruding from said forward end of said first base for releasably holding said lever arm in said latched position, said tabs being arranged over said tongue portion and extending entirely between the forward edges of said first and second side portions; and a pair of wings protruding from said forward end of said second base and between which said pivot is connected, said pair of wings being arranged over said tongue portion and extending entirely between the forward edges of said first and second side portions.

* * * * *